US009636804B2

(12) United States Patent
Wu

(10) Patent No.: US 9,636,804 B2
(45) Date of Patent: May 2, 2017

(54) CLAMPING DEVICE WITH TWO PARALLEL JAWS

(71) Applicant: Ming Chieh Wu, Taichung (TW)

(72) Inventor: Ming Chieh Wu, Taichung (TW)

( * ) Notice: Subject to any disclaimer, the term of this patent is extended or adjusted under 35 U.S.C. 154(b) by 202 days.

(21) Appl. No.: 14/460,429

(22) Filed: Aug. 15, 2014

(65) Prior Publication Data

US 2016/0046002 A1 Feb. 18, 2016

(51) Int. Cl.
*B25B 7/02* (2006.01)
*B25B 7/12* (2006.01)

(52) U.S. Cl.
CPC ..... *B25B 7/02* (2013.01); *B25B 7/123* (2013.01)

(58) Field of Classification Search
CPC ..... B25B 7/02; B25B 7/123
USPC ..... 81/370, 420
See application file for complete search history.

(56) References Cited

U.S. PATENT DOCUMENTS 390,561 A * 10/1888 Brown ..... A61B 1/267 24/267
427,127 A * 5/1890 Spencer ..... B25B 7/02 81/311
D281,195 S * 10/1985 Kurz ..... D24/153
4,709,601 A * 12/1987 Petersen ..... B25B 7/02 81/367
5,357,829 A 10/1994 Schur et al.
5,456,144 A 10/1995 Dahl et al.
5,609,080 A 3/1997 Flavigny
6,473,956 B1 * 11/2002 Tucker ..... B25B 7/02 254/28
6,487,942 B1 * 12/2002 Carter ..... A62C 31/28 81/367
2012/0031243 A1 2/2012 Shih

FOREIGN PATENT DOCUMENTS

| | | | |
|---|---|---|---|
| CN | 2808434 | Y | 8/2006 |
| CN | 201015849 | Y | 2/2008 |
| CN | 201922360 | U | 8/2011 |
| CN | 202292574 | U | 7/2012 |
| DE | 202011001508 | U1 | 3/2011 |
| TW | M320938 | U | 10/2007 |
| TW | M362741 | U | 8/2009 |
| TW | M367063 | U | 10/2009 |
| TW | M400392 | U | 3/2011 |
| TW | M428027 | U | 5/2012 |

* cited by examiner

*Primary Examiner* — Hadi Shakeri
(74) *Attorney, Agent, or Firm* — Alan D. Kamrath; Kamrath IP Lawfirm, P.A.

(57) ABSTRACT

A clamping device includes first and second clamping members. Each of the first and second clamping members has a handle and a jaw. A bend is formed between two ends of the jaw of the first clamping member, and a first angle between the jaw and the handle of the first clamping member is smaller than 180°. Another bend is formed between two ends of the jaw of the second clamping member, and a second angle between the jaw and the handle of the second clamping member is equal to the first angle. The clamping device can be used to clamp a pipe. When the second clamping member is moving from a release position to the clamping position, two clamping portions respectively of the jaws remain parallel to each other such that force is evenly applied to two sides of the pipe.

10 Claims, 9 Drawing Sheets

CLAMPING DEVICE WITH TWO PARALLEL JAWS

BACKGROUND OF THE INVENTION

The present invention relates to a clamping device and, more particularly, to a clamping device with two parallel jaws.

Taiwan Utility Model No. M320938 discloses a general purpose pliers for sealing a rubber hose. The general purpose pliers includes a body having two moveable clamping arms each having a through-hole. Two U-shaped clamping seats are respectively mounted to the moveable clamping arms by extending two rivets through the through-holes. Each clamping seat has an arcuate clamping face. Each clamping seat is pivotable about the corresponding rivet to adjust a clamping opening for clamping rubber hoses of different diameters to completely seal an end of the rubber hose. Furthermore, one of the clamping arms is coupled to one of the moveable clamping arms by a screw and a nut. Thus, the general purpose pliers can reliably seal an end of a rubber hose without any tolerance.

However, when the clamping seats of the general purpose pliers clamp a rubber hose, each clamping seat pivot freely relative to the body such that the angular position of the clamping seat cannot be fixed. Thus, each clamping seat deflects to one of two sides of the rubber hose. Namely, in order to achieve the sealing effect for the rubber hose, a side of the rubber hose is firstly clamped flat by the clamping seats, and, then, the other side of the rubber hose is clamped flat after increasing the pressure applied to the clamping seats. As a result, the stress is concentrated on one of the sides of the rubber hose during the sealing procedure, which could cause breakage of the rubber hose.

Thus, a need exists for a clamping device with two parallel jaws to avoid the drawbacks of the conventional structure.

BRIEF SUMMARY OF THE INVENTION

A clamping device according to the present invention includes a first clamping member having a first handle and a first jaw. The first handle includes a connecting end and a holding end. The first jaw includes a front end and a rear end. The rear end of the first jaw is connected to the connecting end of the first handle. The first jaw further includes a bend between the front end and the rear end of the first jaw. A first line passes through the bend and the front end of the first jaw. A second line passes through the bend and the rear end of the first jaw. A first angle between the first line and the second line is smaller than 180°. The first jaw further includes a clamping portion between the front end and the bend of the first jaw. A second clamping member is coupled to the first clamping member. The second clamping member includes a second handle and a second jaw. The second handle includes a connecting end and a holding end. The second jaw includes a front end and a rear end. The second jaw further includes a bend between the front end and the rear end of the second jaw. A third line passes through the bend and the front end of the second jaw. A fourth line passes through the bend and the rear end of the second jaw. A second angle between the third line and the fourth line is equal to the first angle. The second jaw further includes a clamping portion between the front end and the bend of the second jaw. The clamping portions of the first and second jaws face each other. The second clamping member is moveable relative to the first clamping member between a release position and a clamping position.

When the second clamping member is in the release position, the holding end of the first handle and the holding end of the second handle are away from each other, and the clamping portion of the first jaw and the clamping portion of the second jaw are away from each other.

When the second clamping member is in the clamping position, the holding end of the first handle and the holding end of the second handle are adjacent to each other, and the clamping portion of the first jaw and the clamping portion of the second jaw are adjacent to each other.

The first angle is preferably in a range between 80° and 100°. In an example, the first angle is 90°.

The front end of the first jaw can extend towards a lateral side of the first handle, and the front end of the second jaw can extend towards a lateral side of the second handle.

The bend and the rear end of the first jaw and the holding end of the first handle can be substantially located on the same line. The bend and the rear end of the second jaw and the holding end of the second handle can be substantially located on the same line.

The clamping portion of the first jaw and the clamping portion of the second jaw can be of a rectangular shape and can be planar.

The rear end of the first jaw can be fixed to the connecting end of the first handle. The rear end of the second jaw can include an inner side pivotably connected to the connecting end of the first handle. The rear end of the second jaw can further include an outer side pivotably connected to the connecting end of the second handle. An adjusting member can be threadedly engaged with the holding end of the first handle. The adjusting member moves towards or away from the connecting end of the first handle when the adjusting member rotates relative to the first handle. The second clamping member can further include a pressing member and an elastic element. The pressing member includes a first end pivotably connected between the connecting end and the holding end of the second handle. The pressing member further includes a second end abutting the adjusting member. The second end of the pressing member and the adjusting member are jointly moveable relative to the first handle. The elastic element includes a first end attached to the rear end of second jaw and a second end attached between the connecting end and the holding end of the first handle. The elastic element biases the second jaw and the first handle towards each other.

The second clamping member can further include a releasing member pivotably mounted to the second handle. The releasing member is located between the pressing member and the holding end of the second handle. The releasing member biases the second clamping member from the clamping position to the release position.

The elastic element can be a tension spring.

The clamping device can be used to clamp a pipe. When the second clamping member is moving from the release position to the clamping position, the clamping portion of the first jaw and the clamping portion of the second jaw remain parallel to each other such that force is evenly applied to two sides of the pipe, avoiding stress concentration and, hence, avoiding breaking of the pipe.

Other objectives, advantages, and novel features of the present invention will become clearer in light of the following detailed description described in connection with the accompanying drawings.

DETAILED DESCRIPTION OF THE INVENTION

Figure 1:
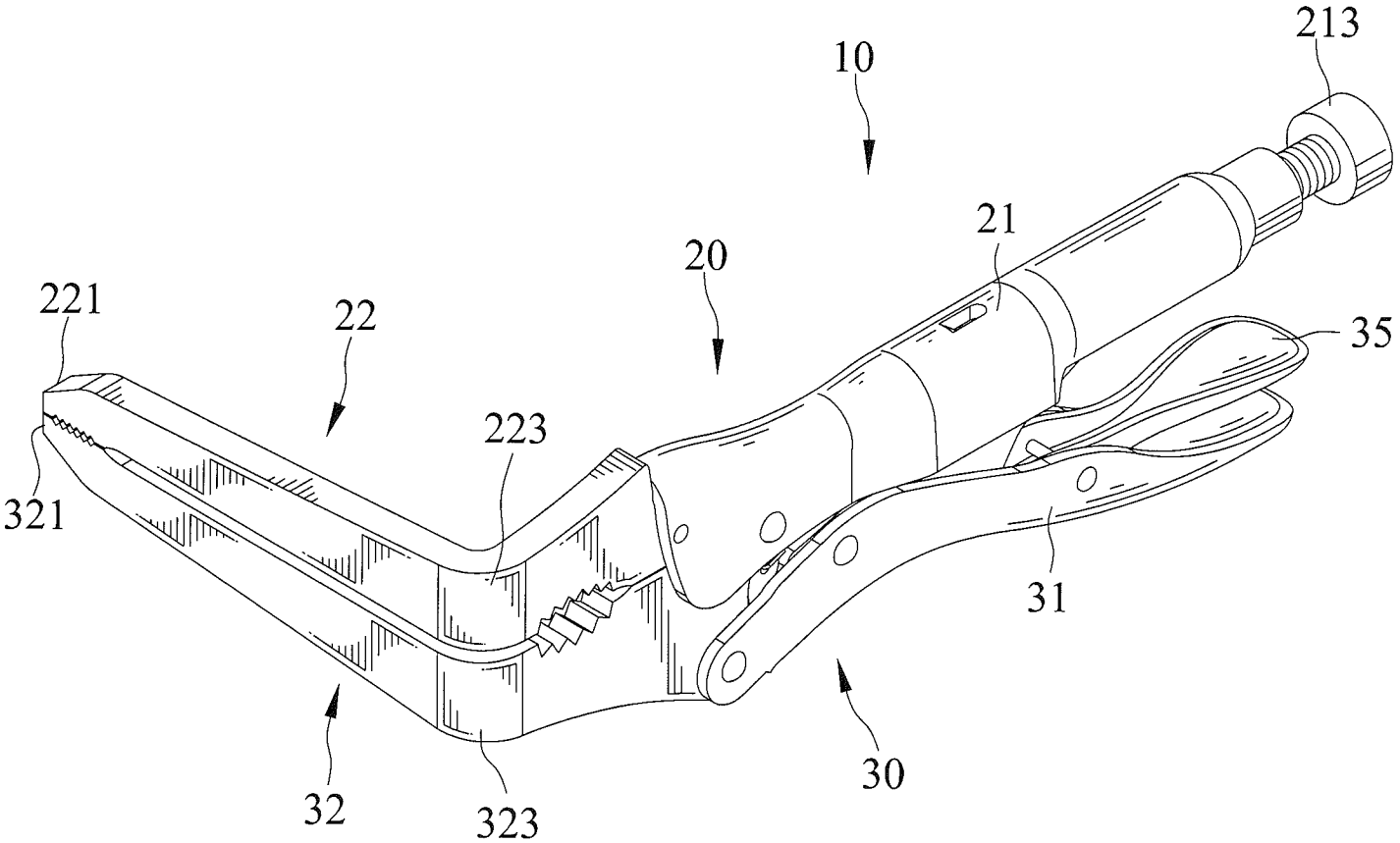
FIG. 1 is a perspective view of a clamping device with two parallel jaws according to the present invention.
Figure 2:
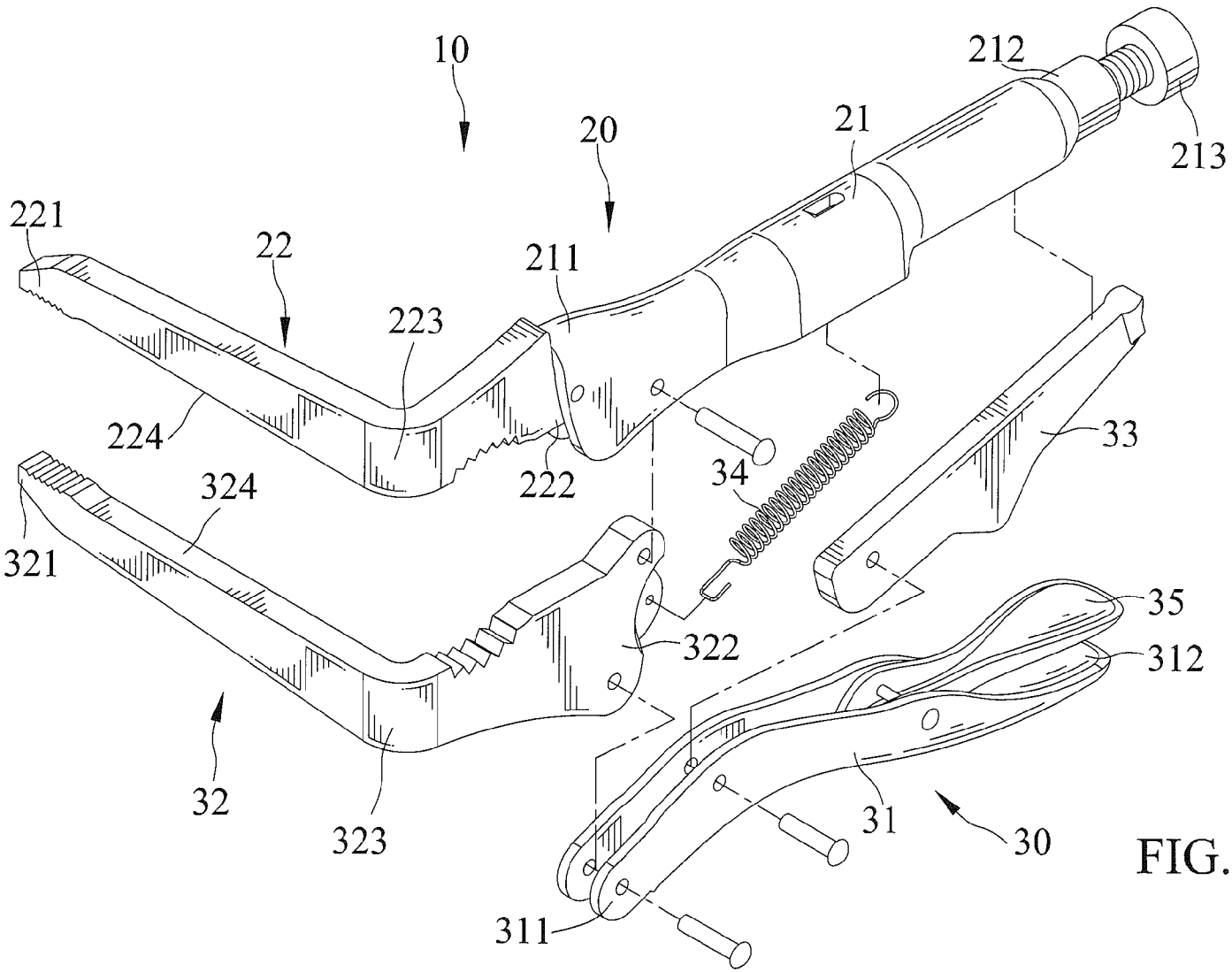
FIG. 2 is an exploded, perspective view of the clamping device of FIG. 1.
Figure 3:
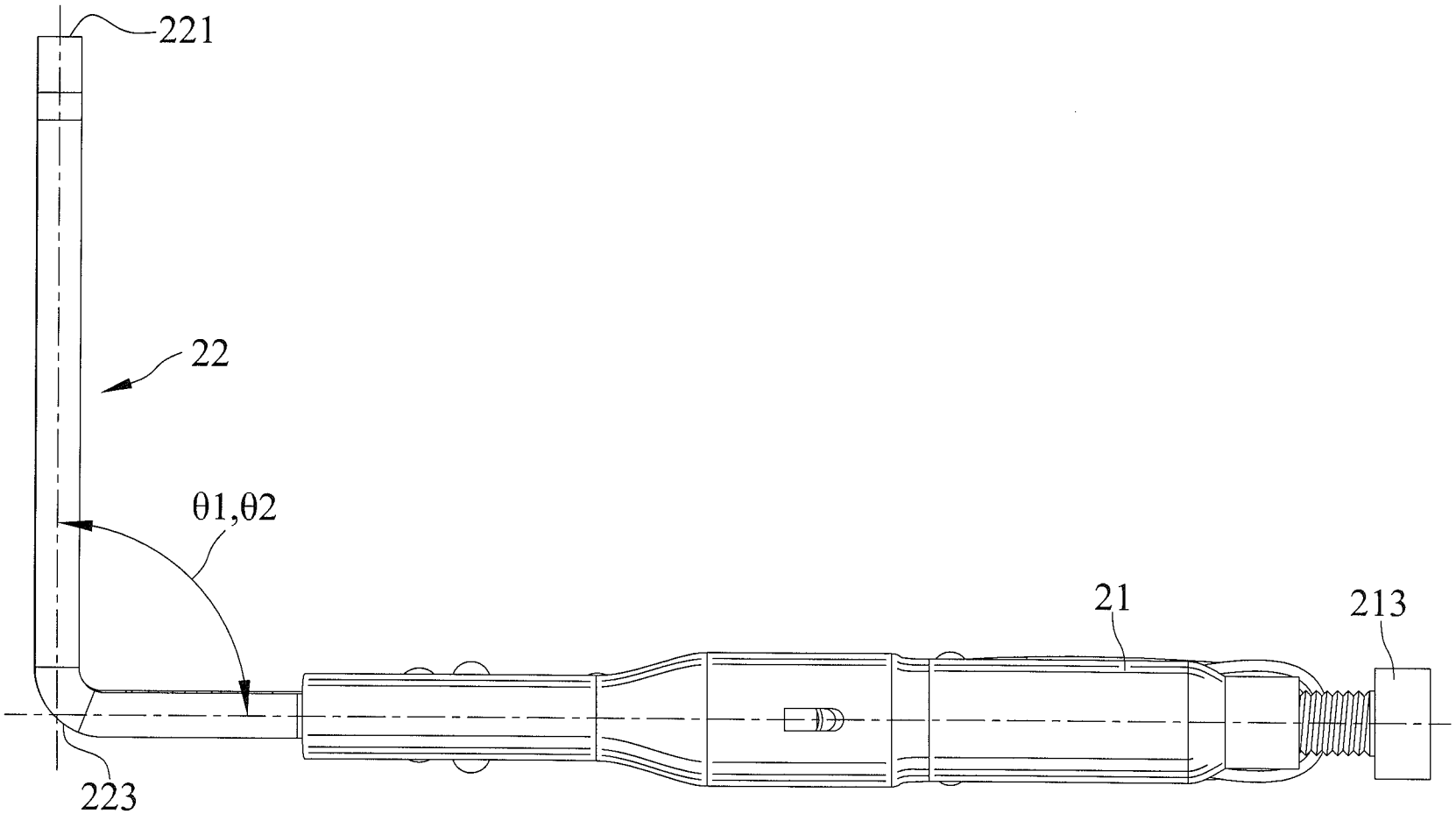
FIG. 3 is a top view of the clamping device of FIG. 1.
Figure 4:
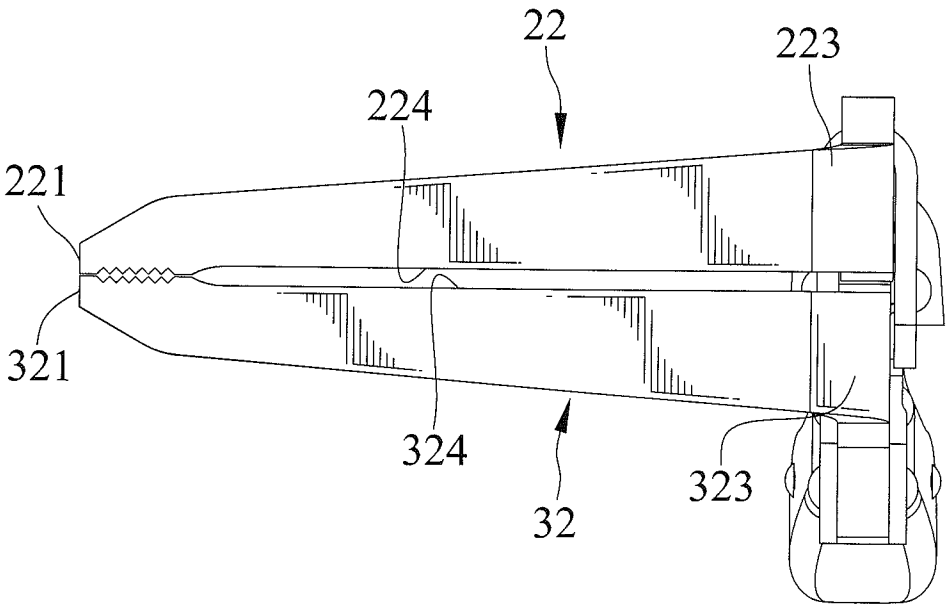
FIG. 4 is a front elevational view of the clamping device of FIG. 1.
Figure 5:
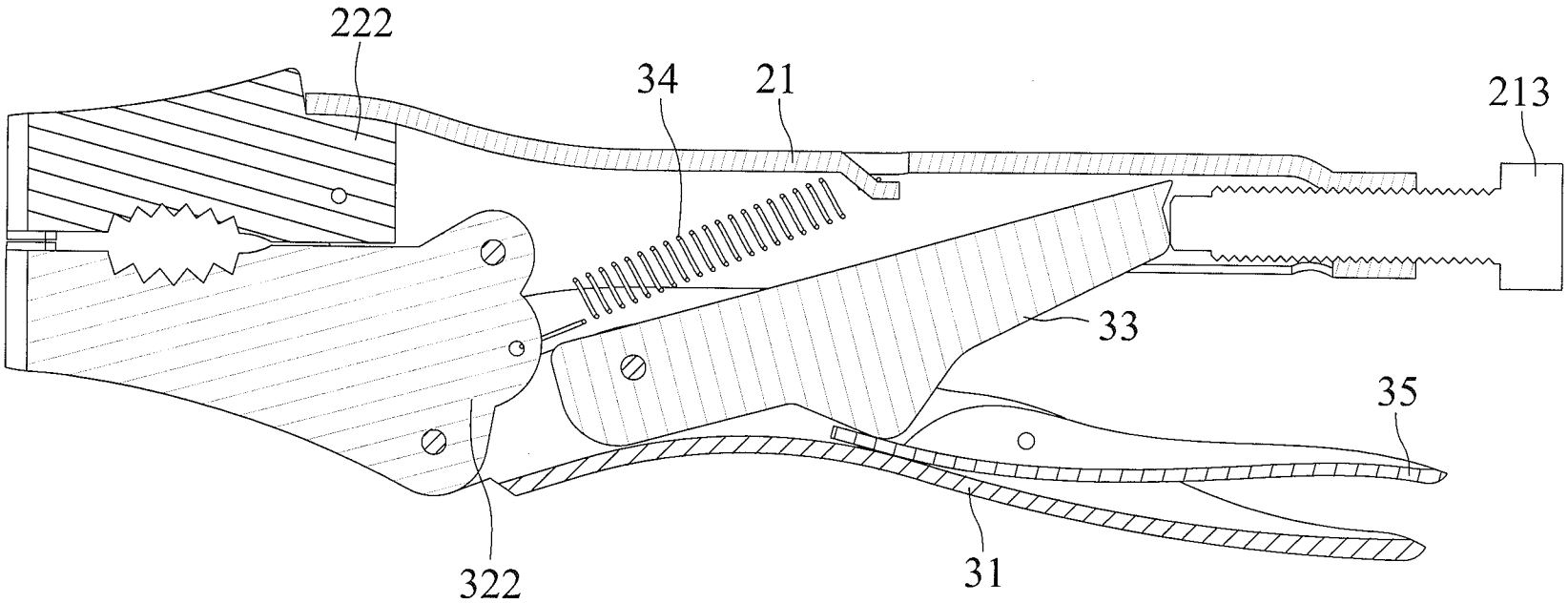
FIG. 5 is a cross sectional view of the clamping device of FIG. 1.

With reference to FIGS. 1-5, a clamping device 10 with two parallel jaws according to the present invention includes a first clamping member 20 and a second clamping member 30.

The first clamping member 20 includes a first handle 21 and a first jaw 22. The first handle 21 includes a connecting end 211 and a holding end 212 opposite to the connecting end 211. An adjusting member 213 is threadedly engaged with the holding end 212 of the first handle 21. The adjusting member 213 moves towards or away from the connecting end 211 of the first handle 21 when the adjusting member 213 rotates relative to the first handle 21.

The first jaw 22 includes a front end 221 and a rear end 222 opposite to the front end 221. The rear end 222 of the first jaw 22 is connected to the connecting end 211 of the first handle 21. The first jaw 22 further includes a bend 223 between the front end 221 and the rear end 222. The front end 221 of the first jaw 22 extends towards a lateral side of the first handle 21. The bend 223 and the rear end 222 of the first jaw 22 and the holding end 212 of the first handle 21 are substantially located on the same line. A first line passes through the bend 223 and the front end 221 of the first jaw 22. A second line passes through the bend 223 and the rear end 222 of the first jaw 22. A first angle θ1 between the first line and the second line is smaller than 180° and can be in a range between 80° and 100°. In this embodiment, the first angle θ1 is 90°. The first jaw 22 further includes a clamping portion 224 between the front end 221 and the bend 223 of the first jaw 22. The clamping portion 224 of the first jaw 22 is of a rectangular shape and is planar. Specifically, the clamping portion 224 includes a gripping section extending from the front end 221 towards the bend 223 and a facing edge extending from the gripping section to the bend 223.

The second clamping member 30 is coupled to the first clamping member 20. The second clamping member 30 includes a second handle 31 and a second jaw 32. The second handle 31 includes a connecting end 311 and a holding end 312 opposite to the connecting end 311. The second jaw 32 includes a front end 321 and a rear end 322 opposite to the front end 321. The rear end 322 of the second jaw 32 includes an inner side pivotably connected to the connecting end 211 of the first handle 21. The rear end 322 of the second jaw 32 further includes an outer side pivotably connected to the connecting end 311 of the second handle 31.

The second jaw 32 further includes a bend 323 between the front end 321 and the rear end 322 of the second jaw 32. The front end 321 of the second jaw 32 extends towards a lateral side of the second handle 31. The bend 323 and the rear end 322 of the second jaw 32 and the holding end 312 of the second handle 31 are substantially located on the same line. A third line passes through the bend 323 and the front end 321 of the second jaw 32. A fourth line passes through the bend 323 and the rear end 322 of the second jaw 32. A second angle θ2 between the third line and the fourth line is equal to the first angle θ1. The second jaw 32 further includes a clamping portion 324 between the front end 321 and the bend 323 of the second jaw 32. The clamping portion 324 of the second jaw 32 is of a rectangular shape and is planar. Specifically, the clamping portion 324 includes a gripping section extending from the front end 321 towards the bend 323 and a facing edge extending from the gripping section to the bend 323. The clamping portions 224 and 324 of the first and second jaws 22 and 32 face each other.

The second clamping member 30 further includes a pressing member 33 and an elastic element 34. The pressing member 33 includes a first end pivotably connected between the connecting end 311 and the holding end 312 of the second handle 31. The pressing member 33 further includes a second end abutting the adjusting member 213. Thus, the pressing member 33 can move jointly with the adjusting member 213 relative to the first handle 21. The elastic element 34 includes a first end attached to the rear end 322 of the second jaw 32 and a second end attached between the connecting end 211 and the holding end 212 of the first handle 21. The elastic element 34 biases the second jaw 32 and the first handle 21 towards each other. In this embodiment, the elastic element 34 is a tension spring.

The second clamping member 30 further includes a releasing member 35 pivotably mounted to the second handle 31. The releasing member 35 is located between the pressing member 33 and the holding end 312 of the second handle 31.

Figure 6:
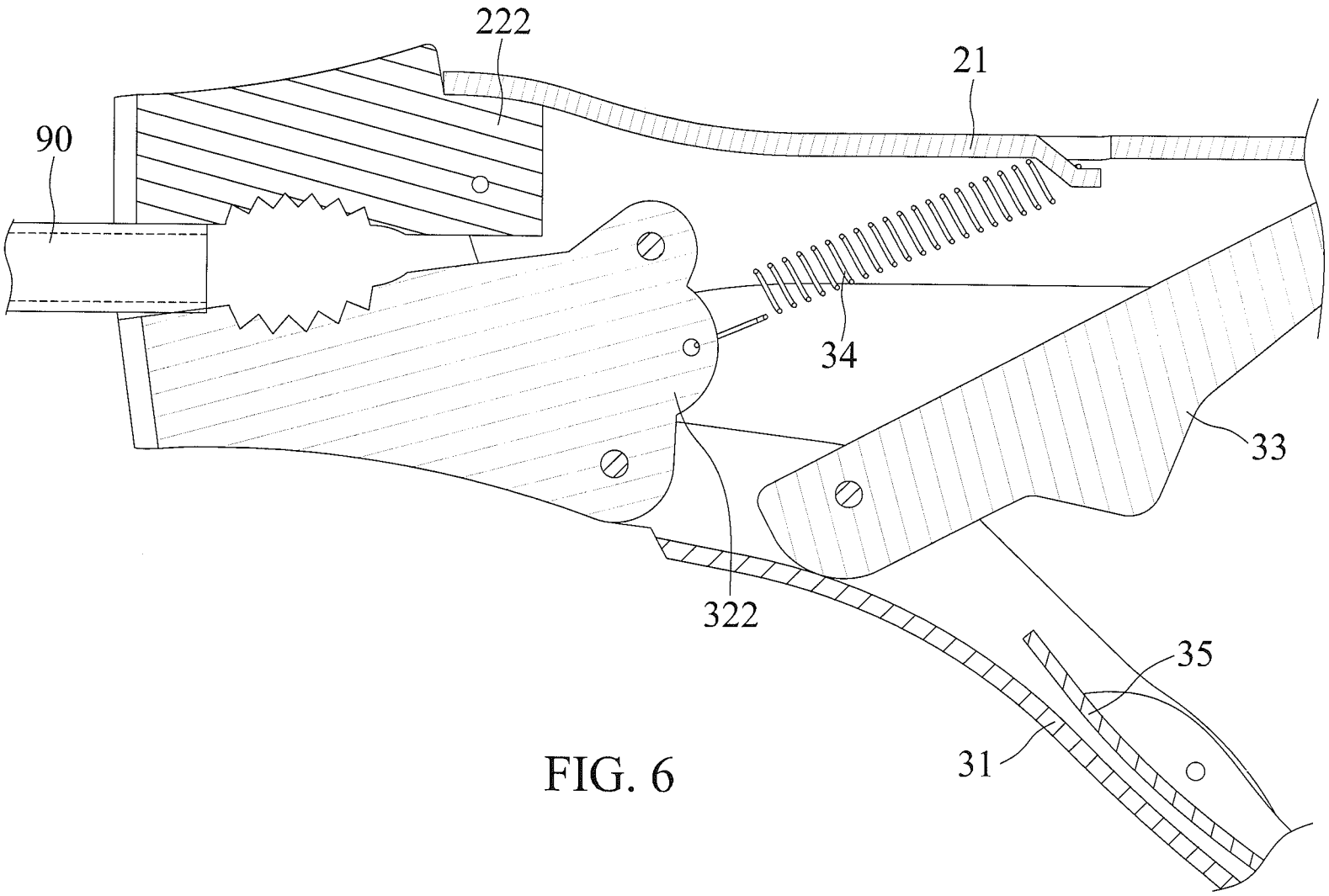
FIG. 6 is a partial, cross sectional view of the clamping device of FIG. 1, with a second clamping member of the clamping device in a release position.
Figure 7:
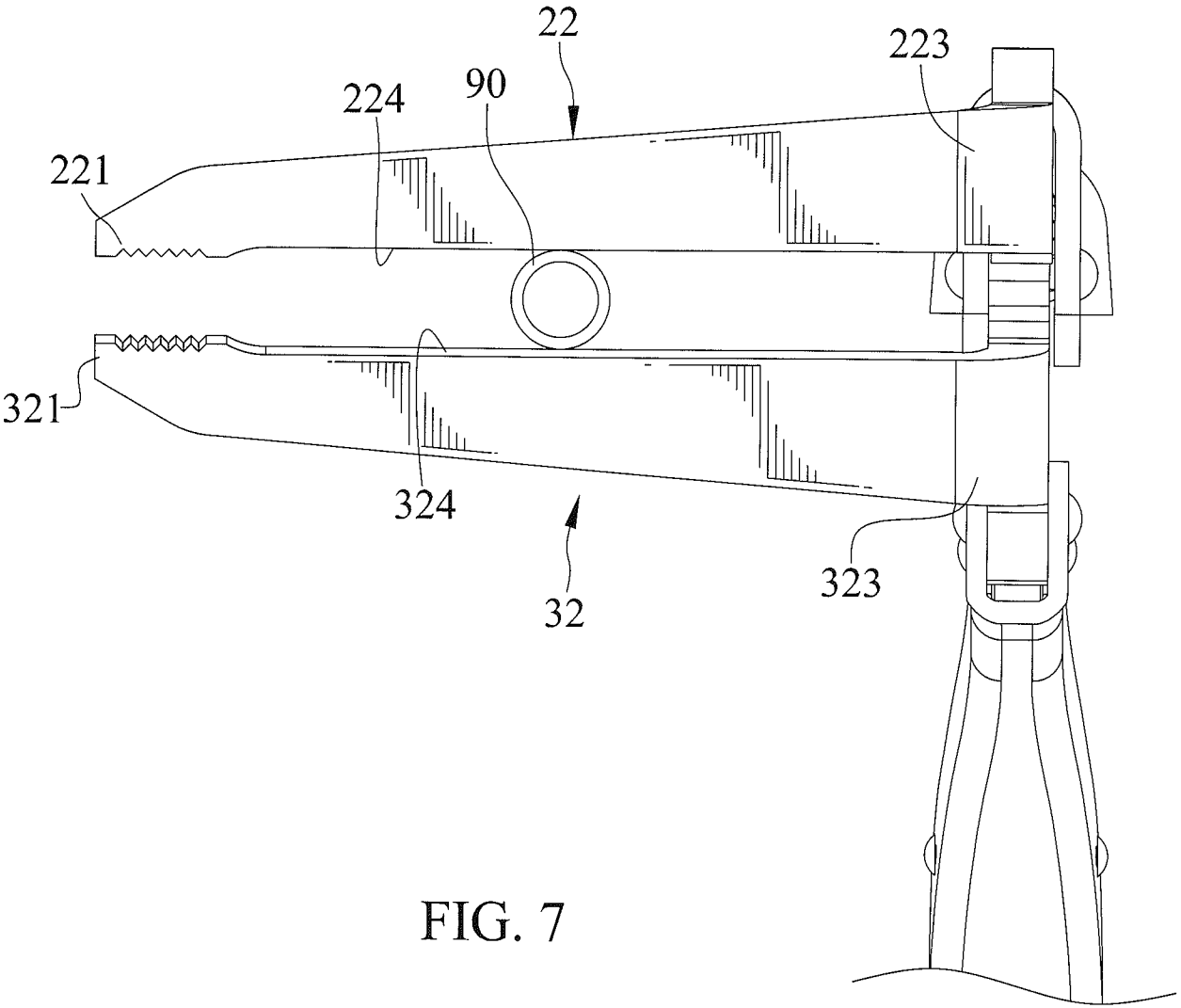
FIG. 7 is a front elevational view of the clamping device of FIG. 1, with the second clamping member in the release position.
Figure 8:
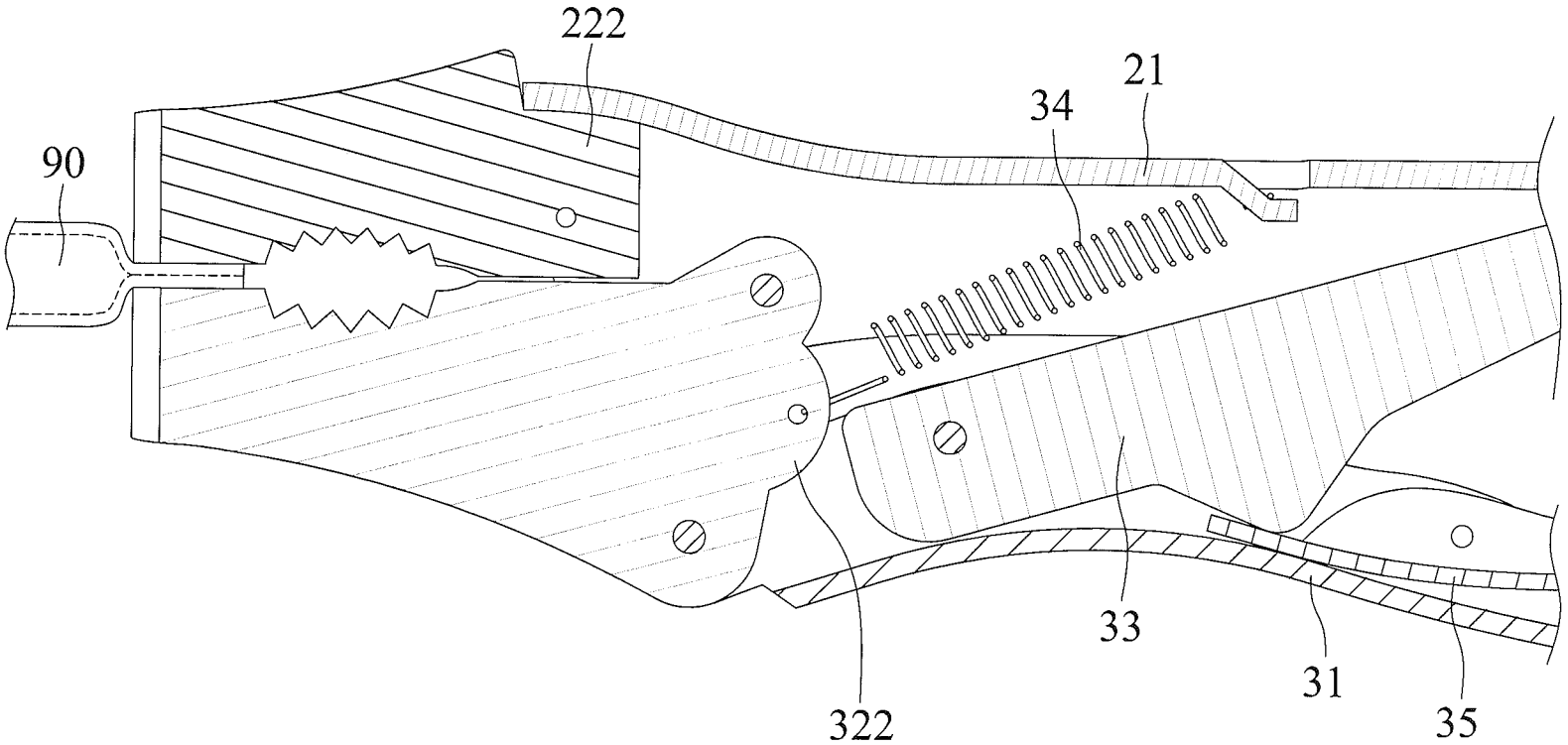
FIG. 8 is a partial, cross sectional view of the clamping device of FIG. 1, with the second clamping member in a clamping position.
Figure 9:
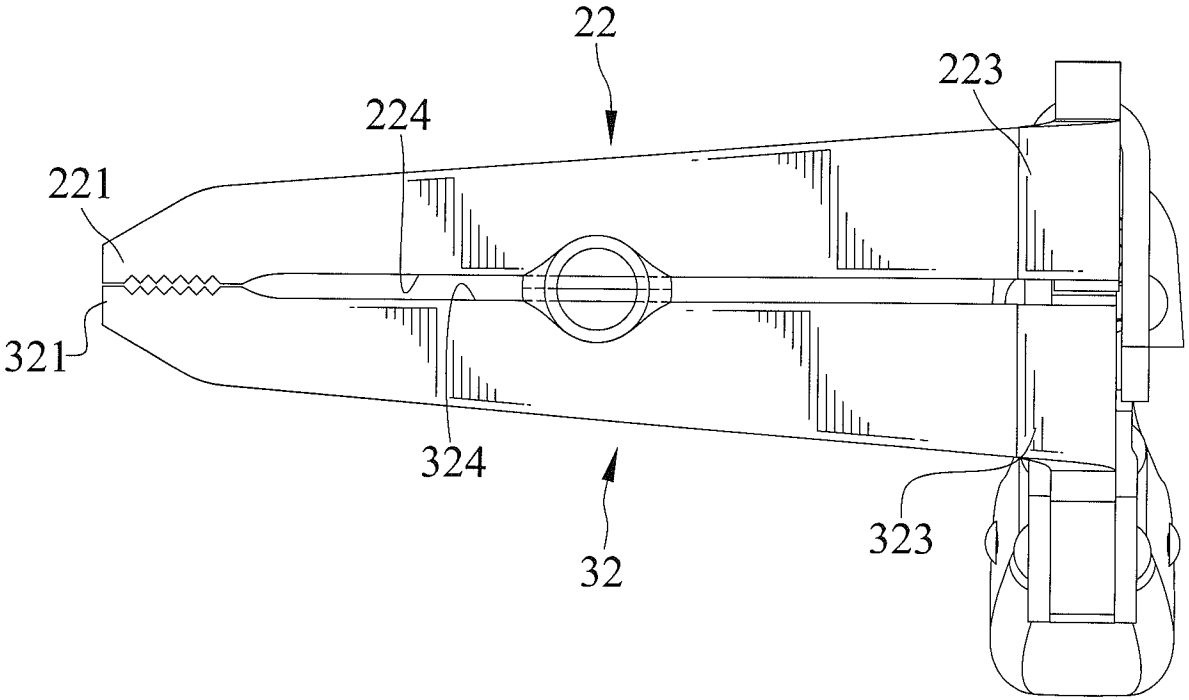
FIG. 9 is a front elevational view of the clamping device of FIG. 1, with the second clamping member in the clamping position.

FIGS. 6-9 illustrate use of the clamping device 10 according to the present invention. The second clamping member 30 is moveable relative to the first clamping member 20 between a release position and a clamping position. When the second clamping member 30 is in the release position, the holding end 212 of the first handle 21 and the holding end 312 of the second handle 31 are away from each other, and the clamping portion 224 of the first jaw 22 and the clamping portion 324 of the second jaw 32 are away from each other. On the other hand, when the second clamping member 30 is in the clamping position, the holding end 212 of the first handle 21 and the holding end 312 of the second handle 31 are adjacent to each other, and the clamping portion 224 of the first jaw 22 and the clamping portion 324 of the second jaw 32 are adjacent to each other.

In use of the clamping device 10, a user can clamp a pipe 90 by the clamping portion 224 of the first jaw 22 and the clamping portion 324 of the second jaw 32. When the second clamping member 30 is moving from the release position to the clamping position, the clamping portion 224 of the first jaw 22 and the clamping portion 324 of the second jaw 32 remain parallel to each other such that force is evenly applied to two sides of the pipe 90, avoiding stress concentration and, hence, avoiding breaking of the pipe 90.

If the user intends to release the pipe 90, the user can press the releasing member 35 to push the second clamping member 30 from the clamping position to the releasing position.

Conclusively, when the second clamping member 30 is moving from the release position to the clamping position, the clamping portion 224 of the first jaw 22 and the clamping portion 324 of the second jaw 32 remain parallel to each other such that force is evenly applied to two sides of the pipe 90, avoiding stress concentration and, hence, avoiding breaking of the pipe 90.

Although preferred embodiments of the present invention have been illustrated and described, they should not be construed to restrict the scope of the present invention. Therefore, modifications to numerical values or substitution of equivalent elements thereof or equivalent changes and modifications based on the accompanying claims of the present invention still fall within the scope covered by the present invention.

The invention claimed is:

1. A clamping device comprising:

a first clamping member including a first handle and a first jaw, with the first handle including a connecting end and a holding end, with the first jaw including a front end and a rear end, with the rear end of the first jaw fixed to the connecting end of the first handle, with the first jaw further including a bend between the front end and the rear end of the first jaw, with a first spacing between the bend-and front end being greater than a second spacing between the bend and the rear end, with a first line passing through the bend and the front end of the first jaw, with a second line passing through the bend and the rear end of the first jaw, with a first angle between the first line and the second line being smaller than 180°, and with the first jaw further including a clamping portion between the front end and the bend of the first jaw;

a second clamping member including a second handle and a second jaw, with the second handle including a connecting end and a holding end, with the second jaw including a front end and a rear end, with the rear end of the second jaw including an inner side pivotably connected to the connecting end of the first handle, with the rear end of the second jaw further including an outer side pivotably connected to the connecting end of the second handle, with the second jaw further including a bend between the front end and the rear end of the second jaw, with the second jaw having a spacing between the front end and the bend equal to the first spacing and greater than a spacing between the bend and the rear end and which is equal to the second spacing, with a third line passing through the bend and the front end of the second jaw, with a fourth line passing through the bend and the rear end of the second jaw, with a second angle between the third line and the fourth line being equal to the first angle, with the second jaw further including a clamping portion between the front end and the bend of the second jaw; and an adjusting member threadedly engaged with the holding end of the first handle, with the adjusting member moving towards or away from the connecting end of the first handle when the adjusting member rotates relative to the first handle, with the second clamping member further including a pressing member and an elastic element, with the pressing member including a first end pivotably connected between the connecting end and the holding end of the second handle, with the pressing member further including a second end abutting the adjusting member, with the second end of the pressing member and the adjusting member jointly moveable relative to the first handle, with the elastic element including a first end attached to the rear end of second jaw and a second end attached between the connecting end and the holding end of the first handle, with the elastic element biasing the second jaw and the first handle towards each other, with the clamping portions of the first and second jaws having toothed sections extending from the respective front ends towards the respective bends and facing edges facing each other and extending from the toothed sections to the respective bends thereof, with the second clamping member moveable relative to the first clamping member between a release position and a clamping position, wherein when the second clamping member is in the release position, the holding end of the first handle and the holding end of the second handle are away from each other, and the clamping portion of the first jaw and the clamping portion of the second jaw are away from each other, wherein when the second clamping member is in the clamping position, the holding end of the first handle and the holding end of the second handle are adjacent to each other, and the clamping portion of the first jaw and the clamping portion of the second jaw are adjacent and extend parallel to each other, and wherein when the toothed section of the clamping portion of the first jaw and the toothed section of the clamping portion of the second jaw abut each other, the facing edges are in a spaced, parallel relation.

2. The clamping device as claimed in claim 1, with the second clamping member further including a releasing member pivotably mounted to the second handle, with the releasing member located between the pressing member and the holding end of the second handle, and with the releasing member biasing the second clamping member from the clamping position to the release position.

3. The clamping device as claimed in claim 2, wherein the elastic element is a tension spring.

4. The clamping device as claimed in claim 1, wherein the facing edges facing each other are of equal width and of a constant size form the front ends to the rear ends.

5. The clamping device as claimed in claim 4, with the front end of the first jaw extending towards a lateral side of the first handle, and with the front end of the second jaw extending towards a lateral side of the second handle.

6. The clamping device as claimed in claim 5, with the bend and the rear end of the first jaw and the holding end of the first handle substantially located on a same fifth line, and with the bend and the rear end of the second jaw and the holding end of the second handle substantially located on a same sixth line.

7. The clamping device as claimed in claim 6, wherein each of facing edges and toothed sections define a rectangular shape along a longitudinal extension.

8. The clamping device as claimed in claim 7, wherein the first angle is in a range between 80° and 100°.

9. The clamping device as claimed in claim 8, wherein the first angle is 90°.

10. The clamping device as claimed in claim 4, wherein the first and second jaws have rectangular cross sections perpendicular to the facing edges thereof and of an increasing size from the front ends to the rear ends.

* * * * *